United States Patent [19]

Zhou et al.

[11] Patent Number: 5,029,291

[45] Date of Patent: Jul. 2, 1991

[54] ELECTROMAGNETIC SENSOR ELEMENT AND METHODS AND APPARATUS FOR MAKING AND USING SAME

[75] Inventors: Y. Peter Zhou, Ronkonkoma; Michael N. Cooper, Hewlett; Kyung-Ho Shin, Lattingtown; Thomas P. Solaski, Hicksville; Jeffrey Taegue, Ronkonkoma, all of N.Y.

[73] Assignee: Knogo Corporation, Hauppauge, N.Y.

[21] Appl. No.: 506,775

[22] Filed: Apr. 10, 1990

[51] Int. Cl.[5] ..... G08B 13/24

[52] U.S. Cl. ..... 340/551; 340/572

[58] Field of Search ..... 340/572, 551, 825.57; 148/103, 108

[56] References Cited

U.S. PATENT DOCUMENTS

| | | | |
|---|---|---|---|
| 2,988,466 | 6/1961 | Meiklejohn | 148/108 X |
| 4,326,198 | 4/1982 | Novikoff | 340/572 |
| 4,623,877 | 11/1986 | Buckens | 340/572 |
| 4,660,025 | 4/1987 | Humphrey | 340/572 |
| 4,800,457 | 1/1989 | Kryder et al. | 340/572 |
| 4,945,339 | 7/1990 | Yamauchi et al. | 340/551 |

OTHER PUBLICATIONS

Wing Kei Ho, et al., Anisotropy Pinning of Domain Walls in Soft Magnetic Material, 8/1989 IEEE.

Exchange Anisotropy, 1977, pp. 43–45 Permanent Magnets.

Meiklejohn, et al., "New Magnetic Anisotropy" Jun. 1, 1956, pp. 1413–1414 Physical review, vol. 102, No. 5.

*Primary Examiner*—Glen R. Swann, III

*Assistant Examiner*—Thomas J. Mullen, Jr.

*Attorney, Agent, or Firm*—Fitzpatrick, Cella, Harper & Scinto

[57] ABSTRACT

A novel sensor element having low magnetic coercivity and an asymmetric hysteresis characteristic is formed by heating a strip of cobalt alloy in an exidizing atmosphere to form an oxide coating thereon and then the strip is cooled in the presence of a magnetic field of about 0.3 oersteds along its length. The strip is detected by subjecting it to an alternating magnetic interrogation field and passing the resulting magnetic disturbances through signal processing circuits which select pulses produced only once in each interrogation field cycle. The element is deactivated by subjecting it to a magnetic field which eliminates its asymmetry.

41 Claims, 7 Drawing Sheets

12
10
19
16
17
28
12 A
30
14
20
24
22
26
18
X
Y
Z

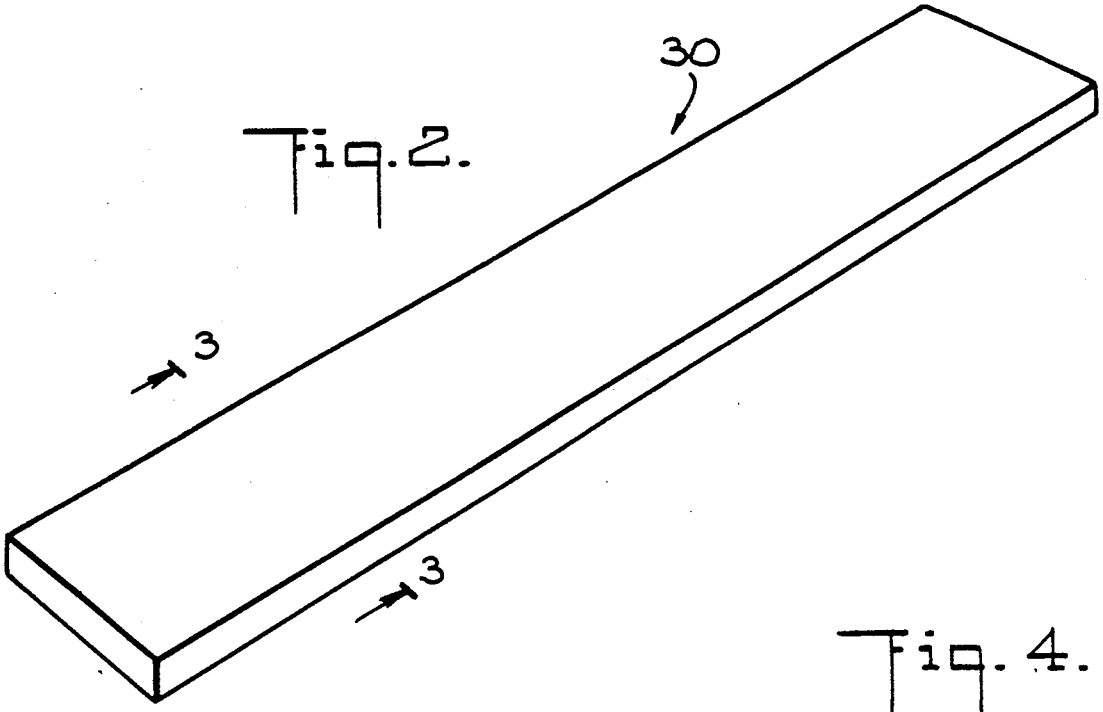
Fig. 2.
Fig. 3.
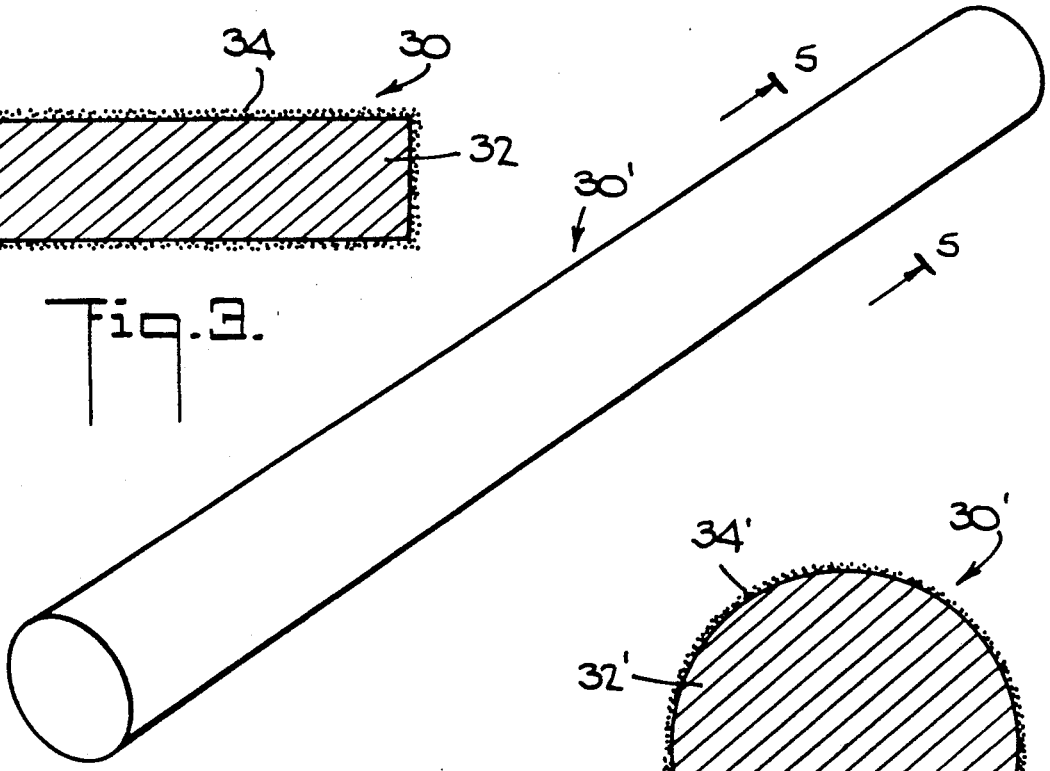
Fig. 4.
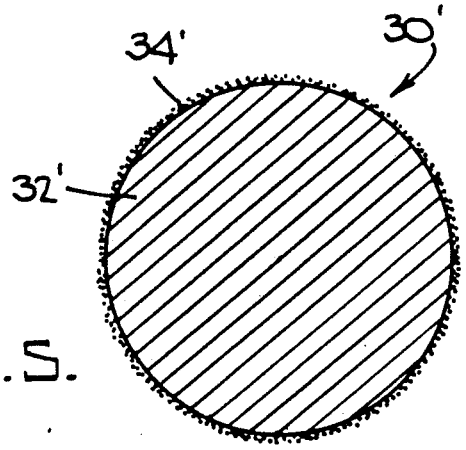
Fig. 5.

Magnetic Field
N
S
40
42
44
46
48
50
52
32
9
10

ELECTROMAGNETIC SENSOR ELEMENT AND METHODS AND APPARATUS FOR MAKING AND USING SAME

BACKGROUND OF THE INVENTION

1. Field of the Invention

This invention relates to detection methods and apparatus and in particular it concerns novel sensor elements, novel methods for making such elements and novel methods and apparatus for detecting such elements.

2. Description of the Prior Art

The present invention is particularly useful in the electronic article surveillance industry, although as will be seen hereinafter, certain aspects of the invention may have application to other industries.

In the article surveillance industry, articles of merchandise, e.g. books, clothing, etc., are protected from theft or other unauthorized removal from a protected area by securing to the articles a target element and providing a target monitor at each exit from the protected area.

One particularly successful article surveillance system is shown and described in detail in U.S. Pat. No. 4,623,877 in the name of Pierre F. Buckens and assigned to the assignee of the present invention.

As shown and described in that patent, elongated target strips of magnetically soft, i.e. easily saturable, low coercivity material are attached to articles to be protected. A transmitter and a receiver are provided with antennas located at the exit from a protected area. The transmitter generates a continuous alternating magnetic field at the exit and when an article with a target strip attached is carried through the exit, the strip is magnetically saturated successively in opposite directions by the alternating magnetic field and thereby produces distinctive disturbances in the field. The thus disturbed field is received by the receiver. The receiver in turn produces corresponding electrical signals and processes them to detect those corresponding to the particular distinctive disturbances produced by the target strips and to actuate an alarm in response to the selected signals.

It is important that the target strips have very distinctive magnetic characteristics so that the disturbances they produce can be distinguished from the disturbances produced by ordinary magnetic objects. In general, targets for such systems should have very low magnetic coercivity, e.g. less than 0.1 oersted; they should be easily magnetically saturable; and they should have a magnetic hysteresis loop which is generally rectangular in shape. Thin elongated strips of a crystalline material, such a Permalloy® or an amorphous material, such as Metglas® have been used in the past as detectable targets.

Various techniques have been used in the past to improve the magnetic characteristics of these target strips to increase the distinctiveness of the disturbances they produce on an incident alternating magnetic field. One such technique, which is described in U.S. Pat. No. 4,660,025, involves maintaining a mechanical stress on the material to increase its Barkhausen characteristics. Another technique, which is described in U.S. Pat. No. 4,326,198, involves applying a continuous magnetic bias to the target strip so that it will produce a preponderance of even harmonics of the incident alternating magnetic field frequency.

It has been observed, although only as a magnetic phenomenon in connection with certain hard magnetic materials and not as a technique having anything to do with easily saturable magnetic materials or sensing devices, that extremely small particles, e.g. 100 to 1000 angstrom units in transverse dimension, of ferromagnetic iron, cobalt or nickel which share a common interface and are magnetically coupled with an antiferromagnetic material of iron oxide, nickel oxide or cobalt oxide will exhibit a shifted hysteresis characteristic with a higher remanence when magnetically polarized in one direction than when magnetically polarized in the opposite direction. Material of this type is described in U.S. Pat. No. 2,988,466.

Another problem associated with electromagnetic sensor devices in the electronic article surveillance industry is that of deactivating the devices so that the articles to which they are attached can be taken from the protected area without activating the alarm when removal has been authorized, for example upon purchase or proper checkout of an article of merchandise. In the past, the devices were provided with spaced apart elements or a continuous strip of a high coercive force magnetic material which, when magnetized, would effectively prevent the device from responding to the alternating magnetic field generated at the exit. The addition of these elements or strips was costly, both in terms of material and assembly; and they substantially increased the physical size of the sensor device. Also, although continuous strip type deactivatable sensor devices were easier to assemble than those with spaced apart elements, the former required actual physical contact with a deactivating magnet in order to effect deactivation; and thus they were less convenient to use.

SUMMARY OF THE INVENTION

According to one aspect of the invention, there is provided a novel sensor element having unique magnetic properties. This novel sensor element comprises a first layer of a cobalt-iron alloy containing a metalloid element such as boron and/or silicon and a second layer comprising a complex metal-metalloid compound formed from the first layer with the first and second layers being exchange coupled.

According to another aspect of the invention there is provided a novel sensor element which comprises a first layer of a ferromagnetic material and a second layer of an antiferromagnetic material exchange coupled with the first layer.

According to a further aspect of the invention, there is provided a novel sensor element which comprises an elongated strip of magnetic material which is magnetically soft, i.e. which has a magnetic coercivity of less than three oersteds and a magnetic hysteresis characteristic having a different slope in one direction of magnetization than in the other direction of magnetization.

According to a still further aspect of the invention, there is provided a novel sensor element which comprises a strip of a cobalt alloy which has been subjected to an oxidizing atmosphere at a temperature and for a time sufficient to form a complex film thereon.

According to yet another aspect of the invention, there is provided a novel article surveillance system which comprises an alternating magnetic field generator, a sensor element and a receiver. The sensor element is in the form of an elongated strip of soft magnetic material and is characterized by having a different slope in one direction of magnetization than in the opposite direction of magnetization and the sensor element is attachable to articles of merchandise to be protected. The receiver is responsive to magnetic waves generated by the generator and it includes a signal processor which produces electrical signals corresponding to received magnetic waves that have been disturbed by the sensor element to produce an alarm. In a preferred embodiment the signal processor is constructed and arranged to prevent production of an alarm in response to signals which occur twice during each cycle of the alternating field magnetic field generator.

In another aspect the present invention involves a novel method for detecting the presence of a sensor element which has a magnetic hysteresis characterized by slopes of different steepness. This method comprises the steps of generating an alternating magnetic field in the interrogation zone, detecting pulses produced by the effect of the sensor element on the magnetic field and producing an alarm in response to the occurrence of one pulse in each cycle of the alternating magnetic field. In a preferred embodiment the detected pulses are passed through two parallel gates. The first gate is timed to be open twice during each cycle of the alternating field and the second gate is timed to be open once during each cycle. The outputs from the first gate are used to inhibit outputs from the second gate.

A still further aspect of the invention involves a novel method of making a sensor element. This novel method comprises the steps of forming a first layer of an alloy of a ferromagnetic material and subjecting the first layer to oxidation to form a second layer thereon of an antiferromagnetic material which is exchange coupled to the first layer.

BRIEF DESCRIPTION OF THE DRAWINGS

FIG. 2 is an enlarged perspective view of a novel composite target according to the present invention as used in the electronic theft detection system of FIG. 1;

FIG. 3 is a further enlarged section view taken along line 3—3 of FIG. 2;

FIG. 4 is an enlarged perspective view of another form of the novel composite target according to the present invention;

FIG. 5 is a further enlarged section view taken along line 5—5 of FIG. 4;

FIG. 13 is a view similar to FIG. 1 but showing a temporarily deactivatable target assembly according to the present invention.

DETAILED DESCRIPTION OF THE PREFERRED EMBODIMENTS

Figure 1:
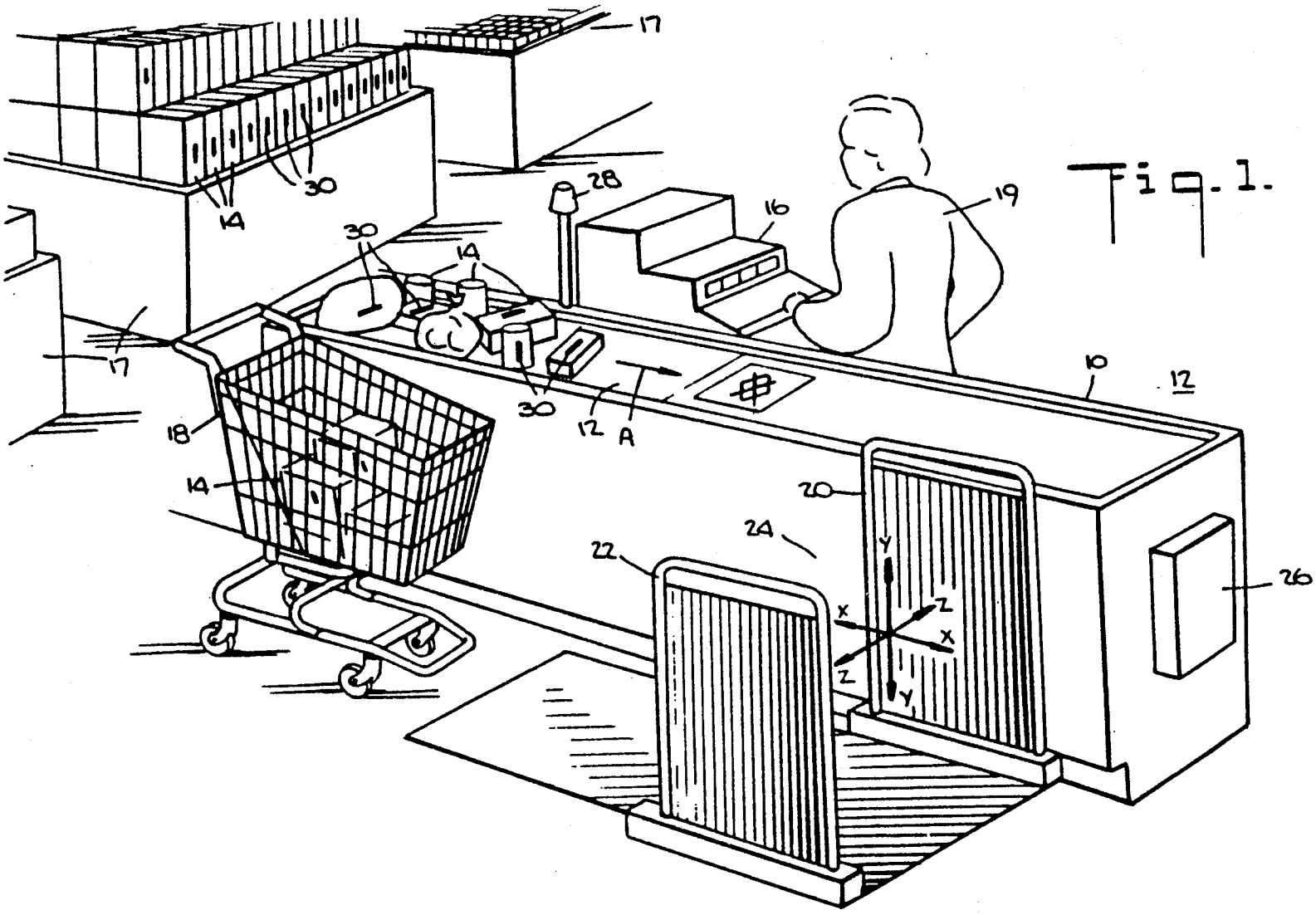
FIG. 1 is a perspective view of an electronic theft detection system embodying the present invention installed in a supermarket.

In FIG. 1 a theft detection system according to the present invention is shown as used in a supermarket to protect against theft of merchandise. As shown, there is provided a supermarket checkout counter 10 having a conveyor belt 12 which carries merchandise, such as items 14 to be purchased, (as indicated by an arrow A) past a cash register 16 positioned alongside of the counter. A patron (not shown) who has selected goods from various shelves or bins 17 in the supermarket takes them from a shopping cart 18 and places them on the conveyor belt 12 at one end of the counter 10. A clerk 19 standing at the cash register 16 records the price of each item of merchandise as it moves past on the conveyor belt. The items are then paid for and are bagged at the other end of the counter. The theft detection system according to this invention includes a pair of spaced apart antenna panels 20 and 22 next to the counter 10 beyond the cash register 16. The antenna panels 20 and 22 are spaced far enough apart to permit the store patron and the shopping cart 18 to pass between them.

The antenna panels 20 and 22 contain transmitter antennas which generate an alternating magnetic interrogation field in an interrogation zone 24 between the panels. The antenna panels 20 and 22 also contain receiver antennas (also described hereinafter) which produce electrical signals corresponding to variations in the magnetic interrogation field in the zone 24. The antennas are electrically connected to transmitter and receiver circuits contained in a housing 26 arranged on or near the counter 10. There is also provided an alarm, such as a light 28, mounted on the counter 10, which can easily be seen by the clerk and which is activated by the electrical circuit when a protected item 14 is carried between the antenna panels 20 and 22. If desired, an audible alarm may be provided instead of, or in addition to, the light 28.

Those of the items 14 which are to be protected against shoplifting are each provided with a target 30 which comprises a thin elongated strip of a special high permeability easily saturable magnetic material according to the present invention. When the protected items 14 are placed on the conveyor belt 12 they pass in front of the clerk 19 who may record their purchase. The items 14 which pass along the counter 10 do not enter the interrogation zone 24 and they may be taken from the store without sounding an alarm. However, any items 14 which remain in the shopping cart 18, or which are carried by the patron cannot be taken from the store without passing between the antenna panels 20 and 22 and through the interrogation zone 24. When an item 14 having a sensor element or target 30 mounted thereon enters the interrogation zone 24, it becomes exposed to the alternating magnetic interrogation field in the zone and becomes magnetized alternately in opposite directions and driven repetitively into and out of magnetic saturation. As a result, the target 30 produces unique disturbances in the magnetic field in the interrogation zone. These unique disturbances which are in the form of alternating magnetic fields at frequencies harmonically related to that of the interrogation field, are intercepted by the receiver antenna which produces corresponding electrical signals. These electrical signals, as well as other electrical signals resulting from the various magnetic fields incident upon the receiver antenna, are processed in the receiver circuits so as to distinguish those produced by true targets from those produced by other electromagnetic disturbances. Upon completion of such processing, the true target produced signals are then used to operate the alarm light 28. Thus the clerk 19 will be informed whenever a patron may attempt to carry protected articles out of the store without being purchased.

FIGS. 2 and 3 show the sensor element or target 30 on the items 14 in FIG. 1. As can be seen, the target 30 is in the shape of a strip or ribbon. The specific dimensions of the target 30 are not critical to the invention, although the target should be long in relation to its cross section. One of the features of the invention is that the target 30 provides easily detectable responses even when its length is less than that of conventional targets. In a presently preferred embodiment the target 30 may have a length of 1.25 inches (31.8 mm) to 7 inches (17.8 cm) and cross sectional dimensions of about 0.0625 inches (1.6 mm) by 0.0013 inches (0.033 mm).

As shown in exaggerated proportion in FIG. 3, the target 30 comprises a substrate 32 which is covered by a coating 34 of finite thickness. The thickness of the coating 34 is less than 0.000,001 inches (0.000025 mm). It is preferred that the coating 34 cover both sides of the substrate 32.

The substrate 32 is a low magnetic coercivity (e.g. less than 0.1 oersteds) ferromagnetic material such as an alloy of cobalt which contains iron and boron and/or silicon. The presently preferred formula for the substrate alloy is $Co_x Fe_{(75-x)} Si_{10} B_{15}$ where x=10 to 72.5 and wherein x and the other subscripts are given in atomic percent. The following formulas are the most preferred: $Co_{68.5} Fe_{6.5} Si_{10} B_{15}$ and $Co_{70.5} Fe_{4.5} Si_{10} B_{15}$. The first composition, i.e. containing $Fe_{6.5}$, provides the best asymmetry as will be described hereinafter. The second composition, i.e. containing $Fe_{4.5}$ provides somewhat less asymmetry but significantly improved resistance to deterioration from cutting and bending. The microstructure of the substrate 32 may be either crystalline or amorphous or a combination; however to avoid excessive brittleness where the principal component is cobalt, it is preferred that the substrate have a certain amount of amorphousness.

The coating 34 is a crystalline antiferromagnetic material which is magnetically exchange coupled with the substrate 32. It is preferred that the coating 34 be a complex compound which contains cobalt because such material is antiferromagnetic and it can be formed directly on the substrate in exchange coupled relation therewith by heating the substrate in an oxidizing atmosphere.

In practice, the sensor element or target 30 may be encased in a protective and/or decorative casing of paper or plastic (not shown); and it or the casing may be provided with suitable adhesive for securing the target to the items 14 of merchandise to be protected.

FIGS. 4 and 5 show another sensor element or target 30' of wire-like configuration. This target also comprises a substrate 32' and a coating 34' of the same materials, respectively, as the substrate 32 and the coating 34 of the target 30 described above.

Figure 6A:
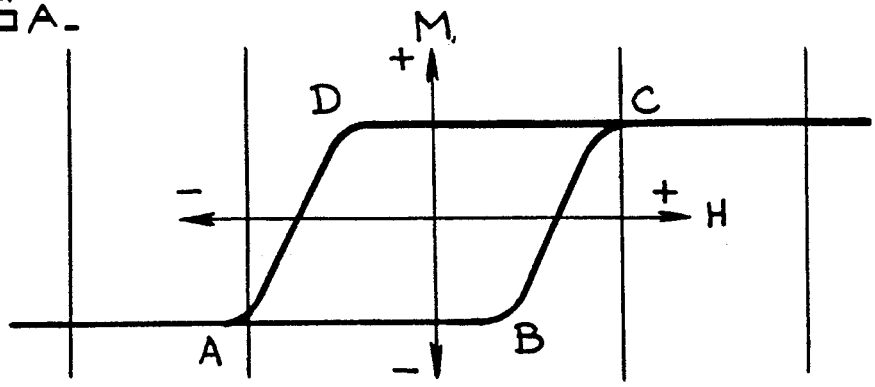
FIG. 6A is a magnetic hysteresis plot of a substrate portion of the targets of FIGS. 2–5.

FIG. 6A shows the magnetic hysteresis characteristic of the material of the target substrates 32 and 32', that is, the magnetic hysteresis they exhibit in the absence of the coating 34 and 34'. The abscissa in FIG. 6A represents the strength (in oersteds) and direction (positive and negative) of an externally applied magnetic field (H) directed along the length of the target substrate. The ordinate in FIG. 6A represents the corresponding magnetization (M) (in gauss) of the target substrate. As can be seen, when the applied magnetic field H is large in the negative direction (i.e. point A), the resulting magnetization M is likewise maximum in the negative direction. At this point the substrate material is magnetically saturated and therefore any increase in the magnitude of the applied magnetic field H in the negative direction will not further increase the magnetization M of the substrate. Now as the applied magnetic field H changes from point A in the positive direction, the magnetization M of the target substrate remains maximally negative, i.e. it remains negatively saturated, until the applied magnetic field H reaches a substantial magnitude in the positive direction at point B. Only at this point does any further increase in the applied magnetic field H cause the magnetization M of the target substrate to increase toward a positive value. Further increase in the applied magnetic field H results in the magnetization H of the target substrate attaining a maximum value in the positive direction at a point C. At this point the target substrate is magnetically saturated and any additional increase in the magnitude of the applied magnetic field will not further increase its magnetization. Thereafter as the applied magnetic field H is changed in the negative direction, the target substrate will remain positively saturated until the applied magnetic field is at a substantial magnitude in the negative direction (point D) whereupon further change in the negative direction of the applied magnetic field will return the target substrate magnetization to saturation in the negative direction (point A). Thus, as the applied magnetic field changes alternately between maximum positive and negative values, it drives the target substrate alternately into and out of saturation in the positive and negative directions, following the path A, B, C, D, A, etc.

Figure 6B:
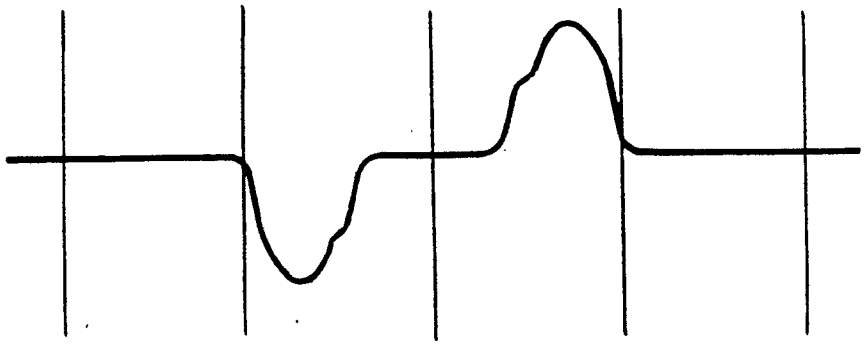
FIG. 6B is a plot of the magnetic field disturbance produced by the substrate portion of the targets of FIGS. 2–5 when they are driven from magnetic saturation in one direction to magnetic saturation in the opposite direction.

As can be seen in FIG. 6A, the target substrate undergoes a large change in magnetization M only through limited portions of the change in applied magnetic field H, namely between points B and C and between points D and A. It is during these changes that the target material disturbs the applied magnetic field and produces distinctive effects which can be detected. The slopes of the hysteresis curve between the points B and C and between the points D and A correspond to the distinctiveness of the magnetic effects produced by the target material. That is, where the slopes are steep, the changing magnetic field produces very sudden changes in magnetization with correspondingly large values of high frequency components. This can be seen in the plot of FIG. 6B which shows the magnetic field disturbance produced by the alternate magnetization of the target substrate. Actually, FIG. 6B is the differential of the hysteresis curve of FIG. 6A along the path A, B, C, D. It will be appreciated that as the applied magnetic field H is swept back and forth between its maximum positive and negative values, the magnetization of the target substrate material will change twice during each sweep cycle, with one change in the negative direction and the other change in the positive direction. Also, it will be noted that the hysteresis curve (FIG. 6A) is essentially symmetrical, with the slopes B-C and D-A being equally steep. Consequently, the magnetization curve of FIG. 6B shows two pulses of essentially the same shape and magnitude which occur during each sweep cycle. The shape or narrowness of these pulses, which corresponds to the high frequency components produced by the target substrate material, and the magnitude of the pulses, both depend on the sharpness of the slope of the hysteresis curve between points B and C and between points D and A.

Nearly all ferromagnetic materials have a hysteresis characteristic which generally corresponds to that shown in FIG. 6A. However, most such materials either require a large applied magnetic field to drive them into and out of magnetic saturation or have a hysteresis characteristic with very shallow slopes. However, there are certain materials, for example permalloy and amorphous alloys of iron, nickel and cobalt, which have a very low magnetic coercivity, i.e. less than 0.1 oersted, that can be saturated in response to very low magnitude magnetic fields and which also have fairly steep slope hysteresis characteristics; and when these materials are formed into long thin target elements they are capable of producing magnetic effects which can be distinguished from most ferromagnetic objects. Accordingly such materials have been used in the past as target elements in magnetic type theft detection systems.

Figure 7A:
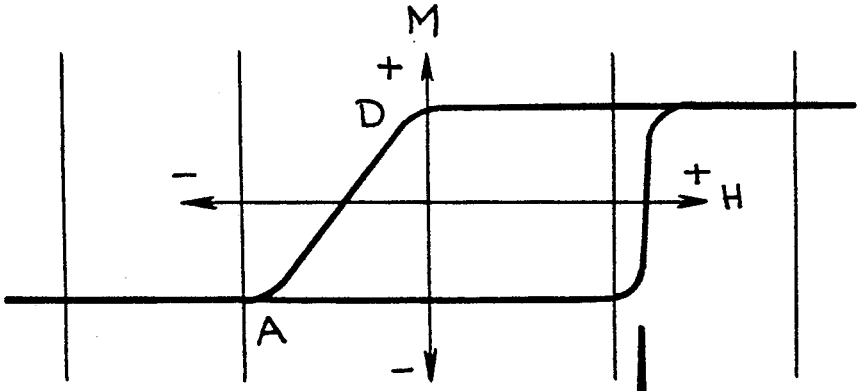
FIG. 7A is a magnetic hysteresis plot of the overall composite targets of FIGS. 2–5.
Figure 7B:
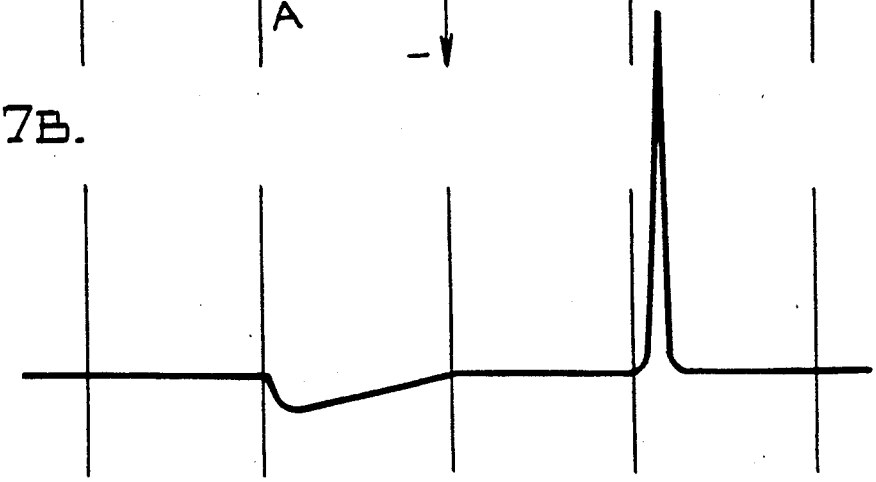
FIG. 7B is a plot of the magnetic field disturbance produced by the overall composite targets of FIGS. 2–5 when they are driven from magnetic saturation in one direction to magnetic saturation in the opposite direction.

FIG. 7A shows the magnetic hysteresis characteristic of the coated sensor element or target 30 and 30' of the present invention. This characteristic is generally similar to that of FIG. 6A, with points A', B', C' and D' corresponding respectively to points A, B, C and D in FIG. 6A. However the characteristic shown in FIG. 7A has two very significant differences from that of FIG. 6A. The first difference is that the slope B'-C' in FIG. 7A is substantially more steep than the slope B-C in FIG. 6A and the second difference is that the slope D'-A' in FIG. 7A is substantially less steep than the slope D-A in FIG. 6A. As a result a very much higher magnitude and narrower pulse (with high frequency components) is produced during magnetization between points B' and C' and a very much lower magnitude and wider pulse is produced during magnetization between points D' and A'.

Both of these features provide significant improvement in the detectability of the target. Firstly, the increase in the magnitude and the accompanying increase in the high frequency components of the pulse produced along the region B'-C' results in a very distinctive signal that is easily detected. Secondly, the decrease in magnitude of the pulse produced along the region D'-A' gives the target an overall asymmetrical characteristic which is extremely rare and therefore makes it possible to detect the target with high accuracy and reliability. A detection system which makes use of these unique characteristics will be described hereinafter.

Figures 8, 9, 10:
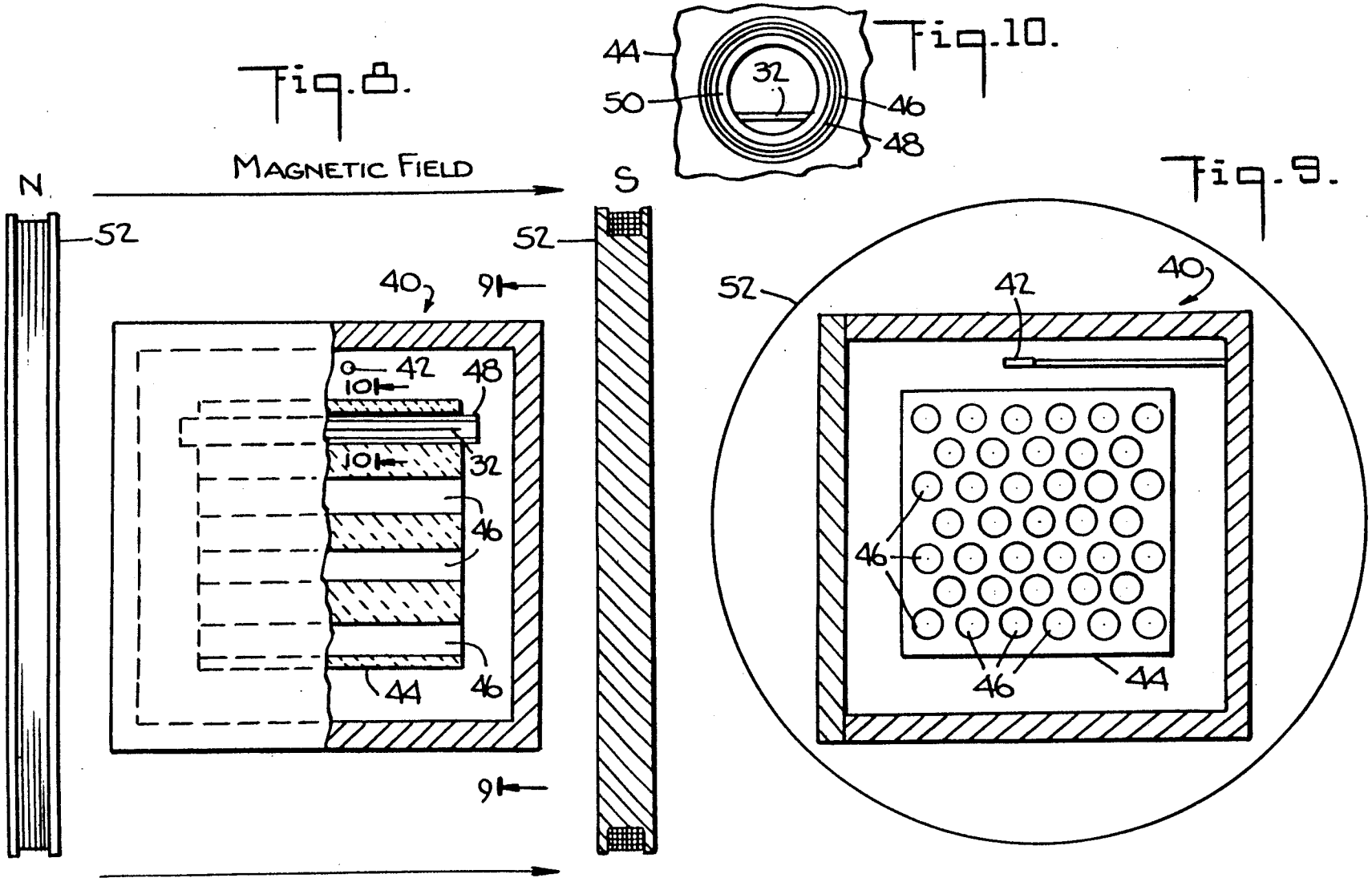
FIG. 8 is a side elevational view, taken in section, of an apparatus for forming the novel targets of the present invention.
FIG. 9 is a view taken along line 9—9 of FIG. 8.
FIG. 10 is an enlarged view taken along line 10—10 of FIG. 8.

The manner in which the novel sensor elements or targets 30 and 30' are made is illustrated in FIGS. 8–10. As shown in FIGS. 8 and 9 there is provided a box furnace 40 of ceramic or other nonferromagnetic material. The furnace 40 contains an electrical heating element (not shown) which is capable of heating the interior of the furnace uniformly to a temperature of 260°–420° C. A thermocouple 42 is positioned in the furnace to monitor the temperature and the thermocouple output is connected to a conventional regulator which adjusts the heat input to the furnace accordingly.

Inside the furnace 40 there is provided a cube shaped specimen organizer 44 of refractory brick. The specimen organizer is formed with a plurality of parallel holes 46 which extend through the organizer from one side thereof to the opposite side. The diameter of the holes should be large enough to accommodate target strips and to permit gases to flow freely around the strips while they are being heated in the furnace. In the present embodiment the holes 46 each have a diameter of about 0.30 inches (0.8 cm).

As shown in FIG. 10, a Permalloy tube 48 is inserted into each of the holes 46 and a non-metallic tube 50 is inserted into each of the permalloy tubes 48. A target substrate 32 or 32' is positioned inside each of the tubes 50.

The furnace 40 is provided with means (not shown) to maintain a continuous supply of gas flowing therethrough and particularly through the tubes 50 in the specimen organizer 44. The gas should be air, pure oxygen or a mixture of argon and oxygen which will oxidize the surface of the target substrates 32 or 32' located in the tubes 50.

The furnace 40 is positioned between a pair of Helmholtz coils 52 which produce a very precisely controlled low magnetic field in a direction perpendicular to their surfaces. The furnace is oriented so that the target substrates 32 and 32' extend in the direction of the magnetic field produced by the Helmholtz coils 52.

To form the targets 30 and 30' a substrate of a cobalt alloy such as described above is positioned inside each of the tubes 50 in the specimen organizer 44 and the specimen organizer is positioned in the furnace 40. The furnace is then heated to a temperature of 260°–420° C. for a period of two hours to eighty hours, until a film forms on the substrate. The precise time and temperature will depend on the composition of the substrate material. By way of example, where the target substrate 32 or 32' is an alloy of the formula $Co_{75-x}Fe_xSi_{10}B_{15}$ ($x=2.5-6.5$ and x and the other subscripts are given in atomic percent), the substrate should be oxidized in air at a temperature of 380° C. for twenty hours.

During the heating process the Helmholtz coils 52 are energized to produce a magnetic field of about 0.3 oersteds along the length of the oxidized target substrates. This magnetic field is maintained until the furnace is cooled down to below the Neel temperature (i.e. the temperature below which antiferromagnetism occurs in the coating). The targets may then be removed from the furnace 40. These targets will then possess the asymmetrical hysteresis characteristic shown in FIG. 7A. The Permalloy tubes 48 serve to isolate the target substrates from the effects of external magnetic fields (including the Earth's magnetic field) other than those produced by the Helmholtz coils, so that the magnetic bias imposed on the targets as they are cooled down to below the Neel temperature can be carefully maintained both as to magnitude and as to direction.

A complete theory of why the sensor elements or targets of this invention exhibit asymmetrical magnetic hysteresis characteristics and greatly increased steepness of one slope of the hysteresis plot is not fully known. However, it is believed that the phenomenon results from the magnetic exchange coupling between the ferromagnetic substrate and the antiferromagnetic coating.

Conventional detection systems for detecting the presence of magnetizable targets can be used to detect the novel targets 30 and 30' of the present invention. One known system for detecting these targets is shown and described in detail in U.S. Pat. No. 4,623,877. Because the targets 30 and 30' provide greatly increased magnitude of high frequency components, the filters and threshold signal level detecting elements in the detection system can be set to produce an alarm only when these high magnitude high frequency signals occur.

Figure 11:
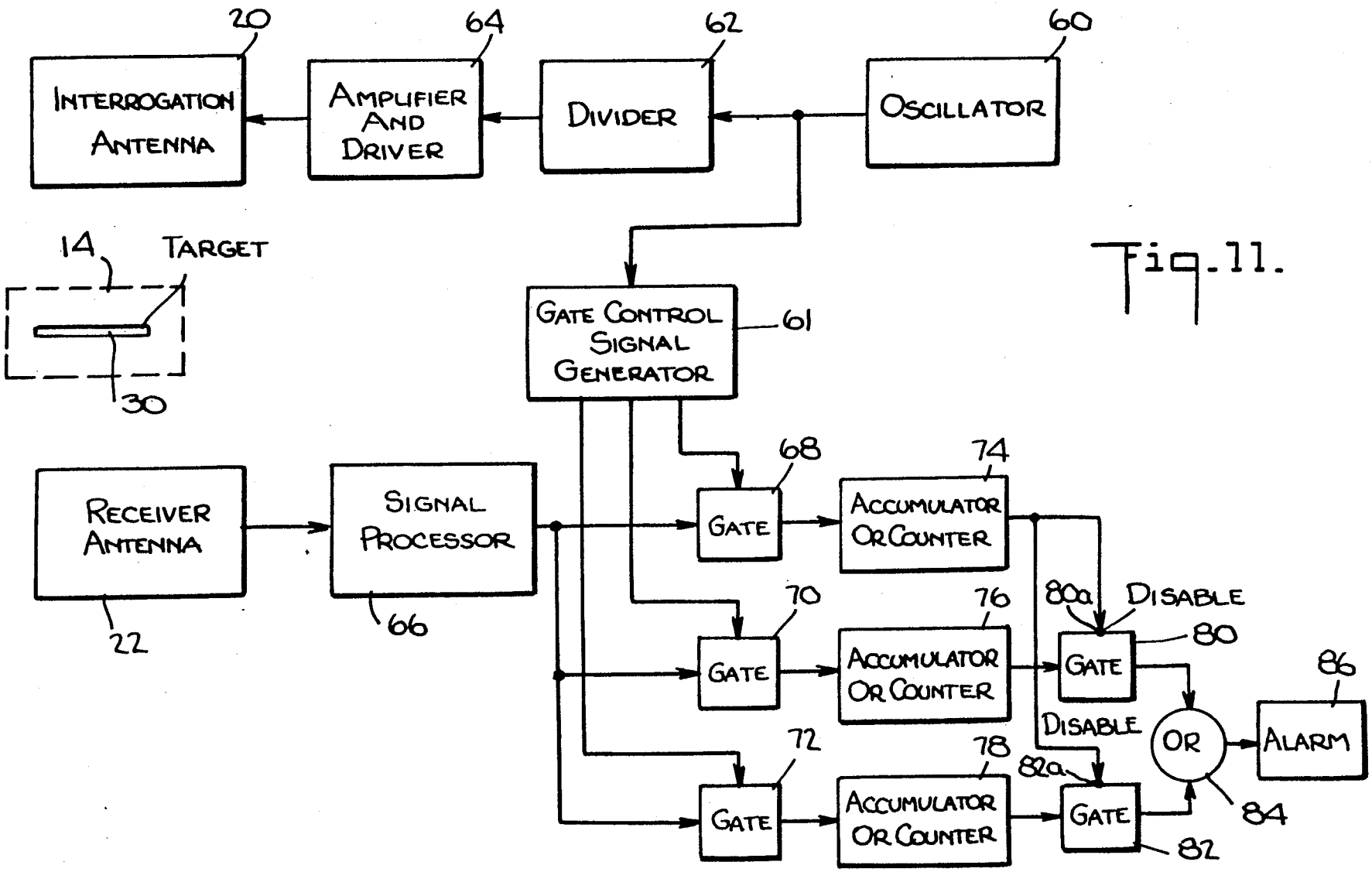
FIG. 11 is a block diagram of the electronic theft detection system of FIG. 1 as configured to utilize the novel characteristics of the targets of the present invention.

FIG. 11 shows, in block diagram form, modifications which could be made to a detection system of the type shown in U.S. Pat. No. 4,623,877 which enable the system to utilize the unique asymmetric hysteresis characteristic of the novel targets of the present invention and provide even better discrimination over magnetic objects that may be present in the vicinity of the detection system.

As shown in FIG. 11 there is provided an oscillator 60 which is connected through a frequency divider 62 to an amplifier and driver 64 which energizes the interrogation antenna 20 at a precise frequency according to a sine wave pattern. The receiver antenna 22, in turn, is connected to a signal processor 66 which contains receiver filters, amplifiers and signal threshold detectors. The signals which are output from the signal processor 66 are applied to each of three gates 68, 70 and 72. The gate outputs in turn are applied to associated signal accumulators or counters 74, 76 and 78. The outputs of the accumulators or counters 74 and 76 are passed through associated output gates 80 and 82 and from there through an OR circuit 84 to an alarm 86. The gates 68, 70 and 72 are controlled by outputs from a gate control signal generator 61 which in turn receives signals from the oscillator 60. Thus, the gates 68 70 and 72 are opened and closed in synchronism with the interrogation field generated by the interrogation antenna 20.

The outputs of the accumulator or counter 74 are applied to disable terminals **80*a* and 82*a* of the output gates 80 and 82**, respectively.

Figures 12A, 12B, 12C, 12D:
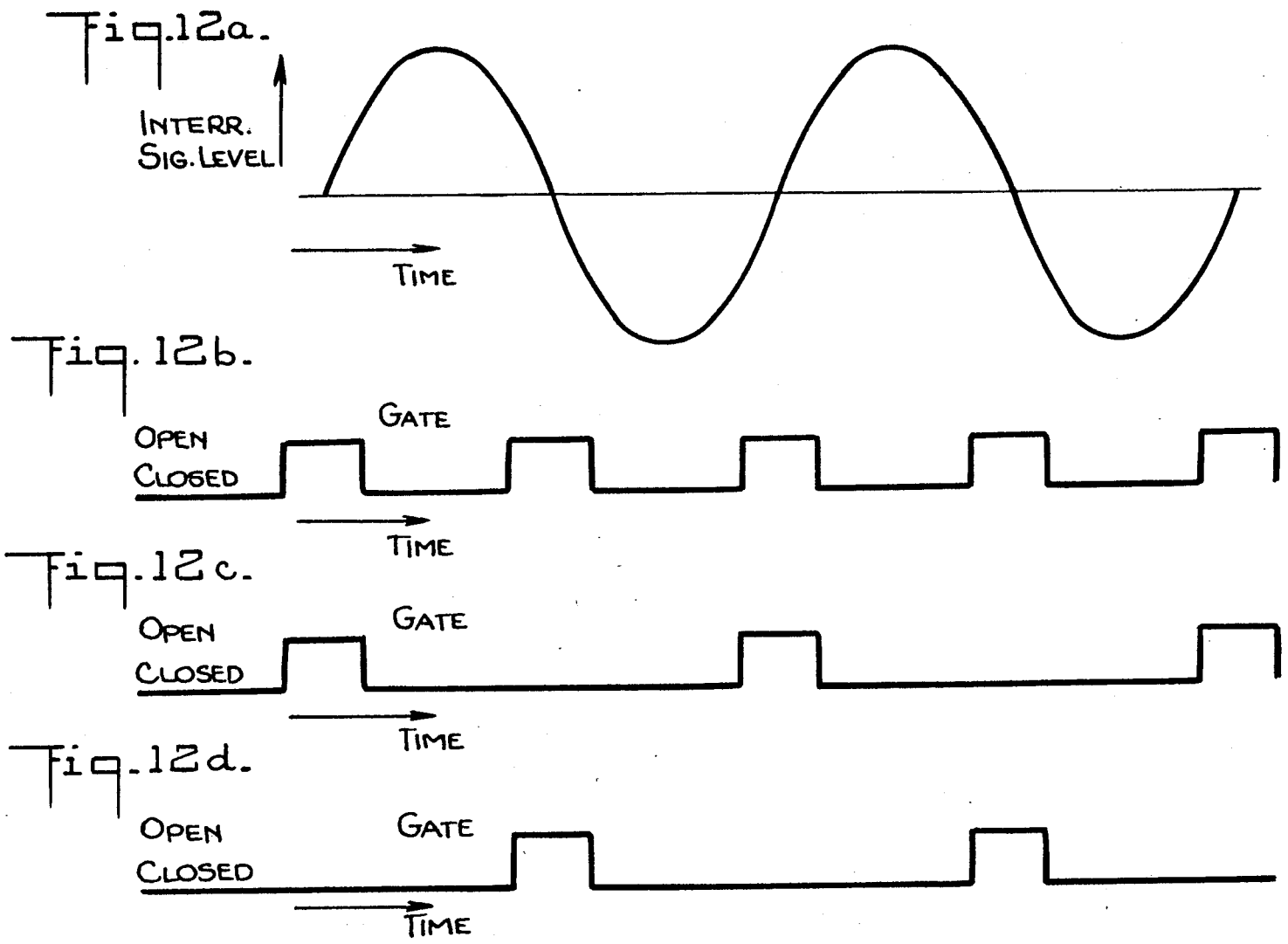
FIGS. 12*a–d* are timing diagrams used in explaining the operation of the electronic theft detection system as configured according to FIG. 11.
Figure 11:
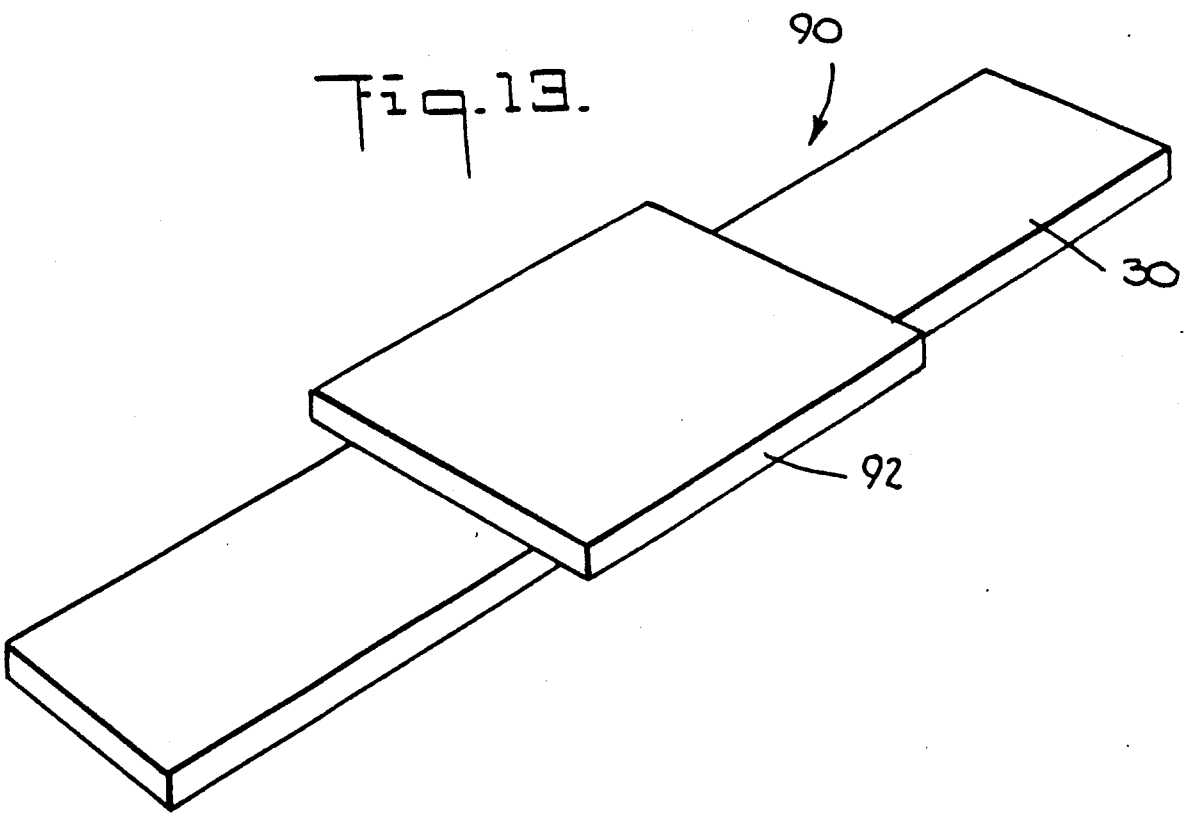

The timing diagrams of FIGS. **12*a*–12*d* illustrate the operation of the arrangement shown in FIG. 11 for selectively detecting the targets 30 and 30' having asymmetrical hysteresis characteristics. FIG. 12*a* represents the magnetic field intensity generated by the interrogation antenna 20 and incident on the target 30. FIG. 12*b* shows the intervals in which the gate 68 is open to pass signals. FIG. 12*c* shows the intervals in which the gate 70 is open to pass signals and FIG. 12*d* shows the intervals in which the gate 72 is open to pass signals. As can be seen, the gate 68 is open during each interval in which the applied magnetic field changes from positive to negative and vice versa. It is during these intervals that the magnetic saturation of the target material should be reversed by the changing interrogation field to produce detectable pulses. Should any electromagnetic signals be incident on the receiver antenna 22 at times other than during these intervals, they would not be from the targets and, accordingly, the gate 68 is not open to pass such signals. Depending on the effects of the earth's magnetic field and other factors, the precise timing of the open intervals of the gate 68 might be shifted somewhat but basically it should be open each time the target 30 or 30'** produces a pulse signal.

The gate 68, as pointed out above, is open each time the magnetic interrogation field shifts from positive to negative and from negative to positive. Thus, the gate 68 is open twice during each cycle of the interrogation signal. The gates 70 and 72, on the other hand, are set to be open only once during each cycle of the interrogation signal. The gate 70 is open each time the interrogation signal changes from negative to positive and the gate 72 is open each time the interrogation signal changes from positive to negative.

If a magnetizable element having the hysteresis characteristic shown in FIG. 6A (i.e. a symmetrical characteristic) passes between the antennas 20 and 22 it will produce signals during each of the intervals when gates 68, 70 and 72 are open. The outputs from the gates 70 and 72 will build up or accumulate in their respective accumulators or counters 76 and 78; however, because the gate 68 is open more often in the same time, its outputs will accumulate faster in its associated accumulator or counter 74 and therefore the output from the accumulator or counter 74 will disable the gates 80 and 82 to prevent detection of the magnetic material having a symmetric hysteresis characteristic.

If a target 30 or 30' of the present invention, having an asymmetric hysteresis characteristic, passes between the interrogation and receiver antennas 20 and 22, it will cause detectable signals to be produced only once during each cycle of the interrogation field, either while the field is changing from positive to negative or while the field is changing from negative to positive, depending on the target orientation. If those signals are generated only while the magnetic interrogation field is changing from positive to negative, they will not pass through the gate 70 but they will pass through the gate 72. Such signals will also pass through the gate 74 but inasmuch as these signals occur only once during each cycle the output from the gate 74 is no greater than the output from the gate 72. The disable terminals **80*a* and 82*a* on the output gates 80 and 82 are set to close their respective gate only when the signal they receive from the accumulators or counters 74 and 76 is appreciably greater than the signals applied to the output gates 80 and 82 from the accumulators or counters 76 and 78. Thus, as long as a target having an asymmetric hysteresis characteristic passes between the antennas 20 and 22**, it will be detected irrespective of its orientation. On the other hand, if an element having a symmetric hysteresis characteristic passes between the antennas it will not be detected.

It will be appreciated that the present invention provides a sensor element, for example, a theft detection target, which responds to applied interrogation fields by producing narrow, high amplitude pulses which have strong high frequency components, particularly in the range of the twentieth harmonic of the interrogation field frequency. Such pulses are unique and easily detectable and this alone provides a substantial advantage over the prior art. Because of this improvement, the targets 30 and 30' can be detected in conventional magnetic type detection systems without modification, except possibly raising of the detection level threshold to further minimize false alarms.

In addition, the targets 30 and 30' of the present invention have asymmetric hysteresis characteristics which enable them to respond to an applied alternating interrogation field by producing only one pulse during each cycle of the field or one pulse which is substantially greater (e.g. three times greater) than the other pulse produced in the same cycle. This provides an additional unique characteristic which, as described, permits even more reliable detection when the detection system is set, for example, as in FIG. 11, to detect only one pulse per cycle of the interrogating magnetic field.

It has been found that the asymmetrical hysteresis characteristic of the targets 30 and 30' can be temporarily cancelled by subjecting them to a magnetic bias field of between 3 and 100 oersteds and preferably from 10 to 20 oersteds. As long as the targets are subjected to such a field their hysteresis characteristic is symmetrical, but when this bias field is removed the asymmetrical hysteresis characteristic is recovered. On the other hand, if the target is subjected to a strong magnetic bias field, for example, greater that 100 oersteds, the asymmetric hysteresis characteristic of the target becomes permanently destroyed; and when the bias field is removed, the target retains a symmetrical hysteresis characteristic.

It should be noted that in both cases referred to above, i.e. while the target is being subjected to a temporary bias field between 3 and 100 oersteds or when it has been subjected to a large bias field in excess of 100 oersteds, the target is merely brought to a condition such that its magnetic hysteresis characteristic is symmetrical. Thus, in each of these cases the target would produce pulses and still be detectable in a prior art detection system. However, in both these cases the target would be effectively deactivated and would not be detectable by a system, such as that described in connection with FIG. 11, which responds only to targets having an asymmetric hysteresis characteristic.

FIG. 13 shows a target assembly 90 which can be temporarily deactivated so that it will not be detected by a system, such as that shown in FIG. 11, which responds only to targets having an asymmetrical hysteresis characteristic. As shown in FIG. 13, the target assembly 90 comprises the target 30 of FIG. 2 and at least one deactivation element 92 of a magnetic material having a magnetic coercivity such that it can be semi-permanently magnetized and when so magnetized will impose a magnetic bias field of about 10 to 20 oersteds on the target 30. When the deactivation element 92 is not magnetized, it has no effect on the target 30. Consequently, the target will retain its asymmetric hysteresis characteristic and will be detectable in the system of FIG. 11. When the deactivation element 92 is magnetized, it will impose a magnetic bias on the target 30 and change its hysteresis characteristic so that it becomes symmetrical and the target assembly 90 cannot then be detected in the system of FIG. 11.

It will be appreciated that this bias field of 10–20 oersteds is far less than the bias field needed to deactivate prior art targets, which is normally well in excess of 60 oersteds. Of course, if the targets 30 or 30' are provided with deactivation elements which impose such a high magnetic bias, the targets will be deactivated so as not to be detectable either by a system such as that of FIG. 11 or by a prior art detection system.

Where one time permanent deactivation is needed to deactivate the target from detection by a system such as that shown in FIG. 11, which responds only to targets with asymmetrical hysteresis characteristics, the target 30 or 30' need not be provided with a deactivation element. Instead, such permanent deactivation can be obtained simply by exposing the target to a magnetic bias field in excess of 100 oersteds.

We claim:

1. A sensor element having unique magnetic properties, said element comprising a first layer of a cobalt-iron alloy containing a metalloid element and a second layer of a complex metal-metalloid compound formed from the first layer, said layers being exchange coupled.

2. A sensor element according to claim 1, wherein said second layer has a crystalline microstructure.

3. A sensor element according to claim 1, wherein said first layer has a composition corresponding to the formula $Co_{(x)}Fe_{(75-x)}Si_{10}B_{15}$ where x is in the range of 10 to 72.5 and x and the other subscripts are given in atomic percent.

4. A sensor element according to claim 3, wherein $x=68.5$.

5. A sensor element according to claim 3, wherein $x=70.5$.

6. A sensor element according to claim 1, wherein said sensor element is in the form of an elongated strip.

7. A sensor element according to claim 1, wherein said second layer surrounds said first layer.

8. A sensor element according to claim 3, wherein said second layer has a thickness of less than 0.000025 mm.

9. A sensor element according to claim 1, wherein a magnetizable element is positioned adjacent said layers, said magnetizable element being magnetizable to an amount sufficient to prevent said layers from exhibiting an asymmetric hysteresis characteristic.

10. A sensor element according to claim 9, wherein said magnetizable element is magnetizable to subject said layers to a magnetic field in the range of 10 to 20 oersteds.

11. A sensor element having unique magnetic properties, said element comprising a first layer of a ferromagnetic material and a second layer of an antiferromagnetic material, said layers being exchange coupled.

12. A sensor element according to claim 11, wherein said second layer has a crystalline microstructure.

13. A sensor element according to claim 11, wherein said sensor element is formed as an elongated strip.

14. A sensor element according to claim 11, wherein said second layer surrounds said first layer.

15. A sensor element according to claim 11, wherein a magnetizable element is positioned adjacent said layers, said magnetizable element being magnetizable to an amount sufficient to prevent said layers from exhibiting an asymmetric hysteresis characteristic.

16. A sensor element comprising an elongated strip of magnetic material having a magnetic coercivity of less than three oersteds and a magnetic hysteresis characteristic having a different slope in one direction of magnetization than in the opposite direction of magnetization.

17. A sensor element comprising an elongated strip of a cobalt-iron alloy containing a metalloid element which has been subjected to an oxidizing atmosphere at a temperature and for a time sufficient to form a film thereon.

18. A sensor element according to claim 17, wherein said strip has a first layer whose composition corresponds to the formula $Co_{(x)}Fe_{(75-x)}Si_{10}B_{15}$ where x is in the range of 10 to 72.5 and x and the other subscripts are given in atomic percent.

19. A sensor element according to claim 18, wherein said strip has been subjected to said oxidizing atmosphere at a temperature in the range of 260°–420° C. for a period of two to eighty hours.

20. A sensor element according to claim 19, wherein said strip has been cooled from said temperature in the presence of a magnetic field of about 0.3 oersteds directed along the length of the strip.

21. A sensor element according to claim 18, wherein said film contains said metalloid element.

22. A sensor element according to claim 21, wherein said film has a thickness of less than 0.000025 mm.

23. An article surveillance system comprising an alternating magnetic field generator, a sensor element in the form of an elongated strip of a soft magnetic material and characterized by a magnetic hysteresis curve having a different slope in one direction of magnetization than in the opposite direction of magnetization, said sensor element being attachable to articles of merchandise to be protected, and a receiver responsive to magnetic waves generated by said generator, said receiver including a signal processor constructed and arranged to produce electrical signals corresponding to received magnetic waves which have been disturbed by said sensor element and to produce an alarm in response thereto.

24. An article surveillance system according to claim 23, wherein said signal processor is constructed and arranged to prevent the production of an alarm in response to signals which occur twice during each cycle of said alternating magnetic field generator.

25. An article surveillance system according to claim 24, wherein said signal processor includes parallel gates through which detected signals are directed means controlling one gate to an open condition to pass said detected signals twice during each cycle of the alternating magnetic field and controlling a second gate to an open condition to pass said detected signals once during each said cycle and means to inhibit outputs from said second gate in response to outputs from said one gate.

26. An article surveillance system according to claim 23, wherein a magnetizable element is positioned adjacent said element and is magnetizable to an extent that it subjects said sensor element to a magnetic bias field sufficient to cause said hysteresis characteristic to have the same slope in opposite directions of magnetization.

27. A method of making a sensor element, said method comprising the steps of forming a first layer of an alloy of ferromagnetic material characterized by a magnetic coercivity less than three oersteds and subjecting said first layer to oxidation to form thereon a second layer of antiferromagnetic material which is exchange coupled with said first layer.

28. A method according to claim 27, wherein said first layer is of a ferromagnetic material which, when subjected to an oxidizing atmosphere, forms said second layer.

29. A method according to claim 27, wherein said first layer is a cobalt alloy.

30. A method according to claim 29, wherein said first layer has a composition corresponding to the formula $Co_{(x)}Fe_{(75-x)}Si_{10}B_{15}$ where x is in the range of 10 to 72.5 and x and the other subscripts are given in atomic percent.

31. A method according to claim 30, wherein $x=68.5$.

32. A method according to claim 30, wherein $x=70.5$.

33. A method according to claim 27, wherein said first layer is subjected to oxidation in a gas from the group consisting of air and a mixture of oxygen and an inert gas.

34. A method according to claim 27, wherein said first layer is subjected to oxidation at a temperature in the range of 260°–420° C. for a period of two to eighty hours.

35. A method according to claim 34, wherein said first layer is cooled from said temperature in the presence of a magnetic field of about 0.3 oersteds directed along the length of said first layer.

36. A method of detecting the presence, of an interrogation region, of a sensor element which has a magnetic hysteresis characterized by slopes of different steepness, said method comprising the steps of generating in said interrogation region an alternating magnetic field, detecting pulses produced by the effect of said sensor element on said magnetic field and producing an alarm in response to the occurrence of one pulse in each cycle of said alternating magnetic field.

37. A method according to claim 36, wherein the step of producing an alarm comprises the steps of directing the detected pulses through parallel gates, a first gate being open to pass pulses twice during each cycle of said alternating magnetic field and a second gate being open to pass pulses once during each cycle of said alternating magnetic field and an inhibit circuit arranged to inhibit outputs of said second gate in response to outputs from said first gate.

38. A method according to claim 36, further including the step of deactivating selected sensor elements by changing their magnetic hysteresis such that they are characterized by slopes of equal steepness.

39. A method according to claim 38, wherein said step of changing the magnetic hysteresis of said sensor elements comprises applying a magnetic field to said elements.

40. A method according to claim 39, wherein said elements comprise a cobalt alloy having a surface layer in exchange relation therewith and wherein said magnetic field is in the range of 10 to 20 oersteds.

41. A method according to claim 39, wherein said elements comprise a cobalt alloy having a surface layer in exchange relation therewith and wherein said magnetic field is in excess of 100 oersteds.

* * * * *

UNITED STATES PATENT AND TRADEMARK OFFICE

CERTIFICATE OF CORRECTION

PATENT NO. : 5,029,291

DATED : July 2, 1991

INVENTOR(S) : Y. PETER ZHOU ET AL.

It is certified that error appears in the above-identified patent and that said Letters Patent is hereby corrected as shown below:

ON THE TITLE PAGE:

AT [75] INVENTORS

"Taegue," should read --Teague,--.

AT [56] REFERENCES CITED

Other Publications,
"Physical review," should read --Physical Review,--.

AT [57] ABSTRACT

Line 3, "exidizing" should read --oxidizing--.

COLUMN 4

Line 6, "and" should be deleted.
Line 10, "FIG. 1" should read --FIG. 2--.

COLUMN 5

Line 31, "cross sectional" should read --cross-sectional--.
Line 50, "$Fe_{4.5}$ provides" should read --$Fe_{4.5}$, provides--.

COLUMN 10

Line 37, "74" should read --68--.
Line 39, "74" should read --68--.
Line 42, "gate" should read --gates--.

UNITED STATES PATENT AND TRADEMARK OFFICE

CERTIFICATE OF CORRECTION

PATENT NO. : 5,029,291

DATED : July 2, 1991

INVENTOR(S) : Y. PETER ZHOU ET AL.

It is certified that error appears in the above-identified patent and that said Letters Patent is hereby corrected as shown below:

COLUMN 13

Line 34, "directed means" should read --directed, means--.
Line 43, "said element" should read --to said element--.

COLUMN 14

Line 24, ", of" should read --in--.

Signed and Sealed this

Eighth Day of September, 1992

*Attest:*

DOUGLAS B. COMER

*Attesting Officer*

*Acting Commissioner of Patents and Trademarks*